US009347110B2

(12) United States Patent
Hill

(10) Patent No.: US 9,347,110 B2
(45) Date of Patent: May 24, 2016

(54) PRESS QUENCH MACHINE

(71) Applicant: The Lund Industrial Group, Holly Springs, MS (US)

(72) Inventor: Earl E. Hill, Rossville, TN (US)

(73) Assignee: The Lund Industrial Group, Holly Springs, MS (US)

( * ) Notice: Subject to any disclaimer, the term of this patent is extended or adjusted under 35 U.S.C. 154(b) by 234 days.

(21) Appl. No.: 14/173,115

(22) Filed: Feb. 5, 2014

(65) Prior Publication Data

US 2014/0327193 A1 Nov. 6, 2014

Related U.S. Application Data

(60) Provisional application No. 61/818,436, filed on May 1, 2013.

(51) Int. Cl.

| | |
|---|---|
| ***C21D 1/63*** | (2006.01) |
| ***C21D 1/667*** | (2006.01) |
| ***C23C 24/10*** | (2006.01) |
| ***C21D 1/673*** | (2006.01) |
| ***C21D 1/70*** | (2006.01) |
| *C21D 1/18* | (2006.01) |

(52) U.S. Cl.

CPC *C21D 1/63* (2013.01); *C21D 1/667* (2013.01); *C21D 1/673* (2013.01); *C21D 1/70* (2013.01); *C23C 24/10* (2013.01); *C21D 1/18* (2013.01); *C21D 2251/02* (2013.01)

(58) Field of Classification Search

CPC ..... C21D 1/63; C21D 1/673
USPC ..... 266/260
See application file for complete search history.

(56) References Cited

U.S. PATENT DOCUMENTS

2012/0073349 A1* 3/2012 Ko ..... B21D 37/16 72/342.3

* cited by examiner

*Primary Examiner* — Scott Kastler
(74) *Attorney, Agent, or Firm* — David J. Kreher

(57) ABSTRACT

This invention is an apparatus for cooling a metal object that has been heated above the curing point, such that as the metal object cools, it retains its original shape.

2 Claims, 4 Drawing Sheets

PRESS QUENCH MACHINE

CROSS-REFERENCE TO RELATED APPLICATIONS

Ser. No. 14/173,059 November, 2013 Hill
61/818,436 May, 2013 Hill

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC

Not Applicable

FIELD OF THE INVENTION

This invention is an apparatus for cooling a metal object that has been heated above the curing point such that as the metal object cools the metal object retains its original shape.

BACKGROUND OF THE INVENTION

When a metal object is heated above its curing temperature, the metal object deforms as it cools, losing its original shape and utility unless the metal object is contained within a mold or framework. Because of the problem of deformation, a metal object cannot be fabricated in a particular shape and later modified using heating techniques without the metal object becoming deformed. The press quench machine is designed to supply a framework for the metal object's shape such that when the preformed metal object is inserted into the framework, pressure is applied to the metal object. The metal object can then be submerged in a quenchant bath for a sufficient duration to allow the metal object to cool below the curing temperature. Because the framework places confining pressure on the metal object during the cooling process, the metal object does not deform and when the metal object is removed from the framework it will still possess the same shape it possessed prior to heating.

In U.S. patent application Ser. No. 14/173,059 Hill teaches a metal coating method for the purpose of fusing an abrasion resistant and wear resistant coating onto a piece of metal.

In U.S. Patent Application 61/818,436 Hill teaches a wear coating and method of application to a flat agricultural disk.

In U.S. patent application Ser. No. 12/0,073,349, Ko reveals a collection of hoses extending from the quenchant bath to the recirculation tank which includes the cooling unit, and then the hoses return to the quenchant bath on the opposite side of as those hoses that go to the recirculation tank. Ko further reveals a plurality of channels through the upper base plate and lower base plate through which coolant can flow by gravity. However, the present disclosure reveals a collection of hoses that extend from the recirculation tank to a plurality of nozzles that are attached to the pressure assembly, thus causing the coolant to be sprayed directly on the object to be cooled, thus making the present disclosure distinguishable from Ko.

SUMMARY OF THE INVENTION

A press quench machine designed with a pressure assembly with a plurality of stops and plurality of upper vertical die plates and a plurality lower vertical die plates. Said stops, upper vertical die plates and lower vertical die plates designed to form the structure of a metal object such that when the metal object is heated and then inserted into the pressure assembly, pressure is placed on the metal object to ensure that as the metal object cools it retains its original shape. The press quench machine further consists of a quenchant bath to facilitate the cooling of the heated metal object.

DETAILED DESCRIPTION OF THE INVENTION

The press quench machine 1 comprises a pressure assembly 2, a quenchant bath 3 and a recirculation tank 4.

Figure 1:
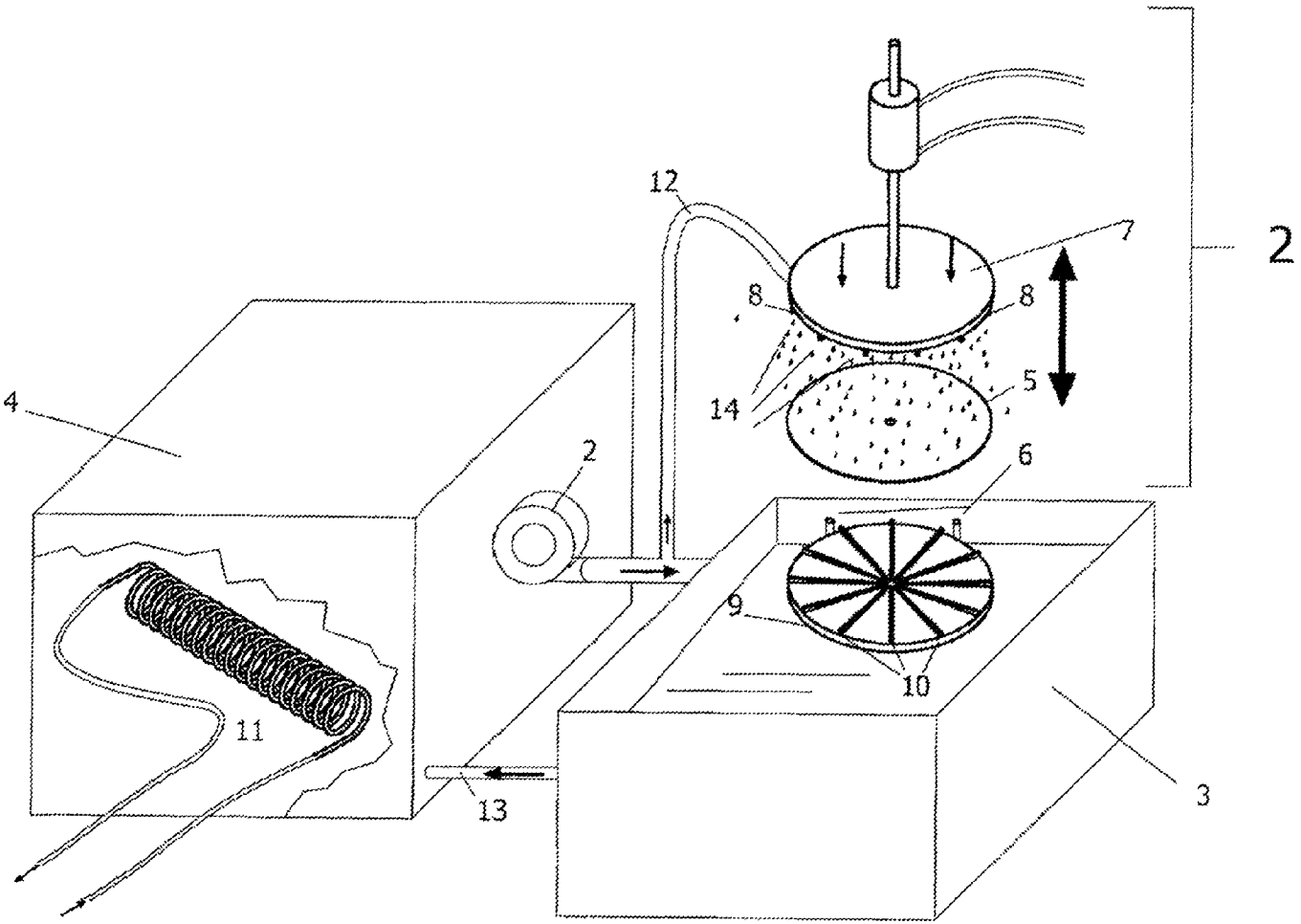
FIG. 1 is a display of the press quench machine, which comprises a pressure assembly, a quenchant bath and a recirculation tank.
Figure 2:
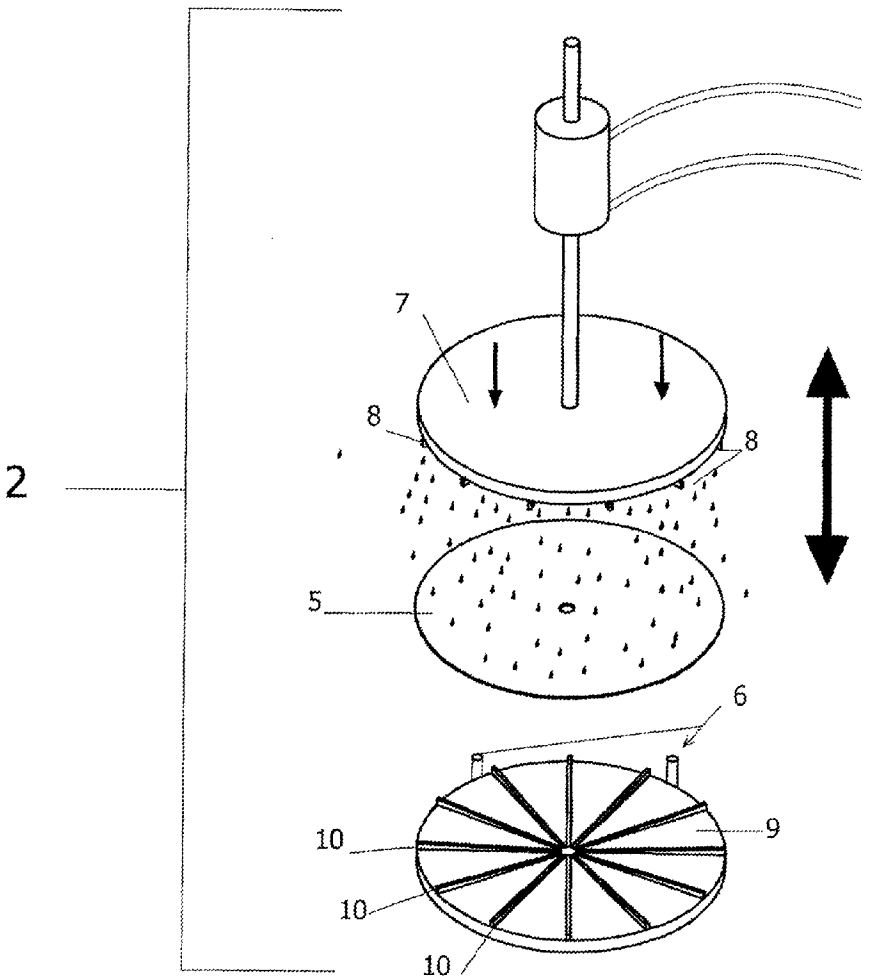
FIG. 2 is a display of the pressure assembly, including the upper base plate, lower base plate, a plurality of upper vertical die plates extending downward from the upper base mount, a plurality of lower vertical die plates extending upward from the lower base plate, a plurality of stops, and a plurality of nozzles that spray quenchant onto the metal object.
Figure 3B:
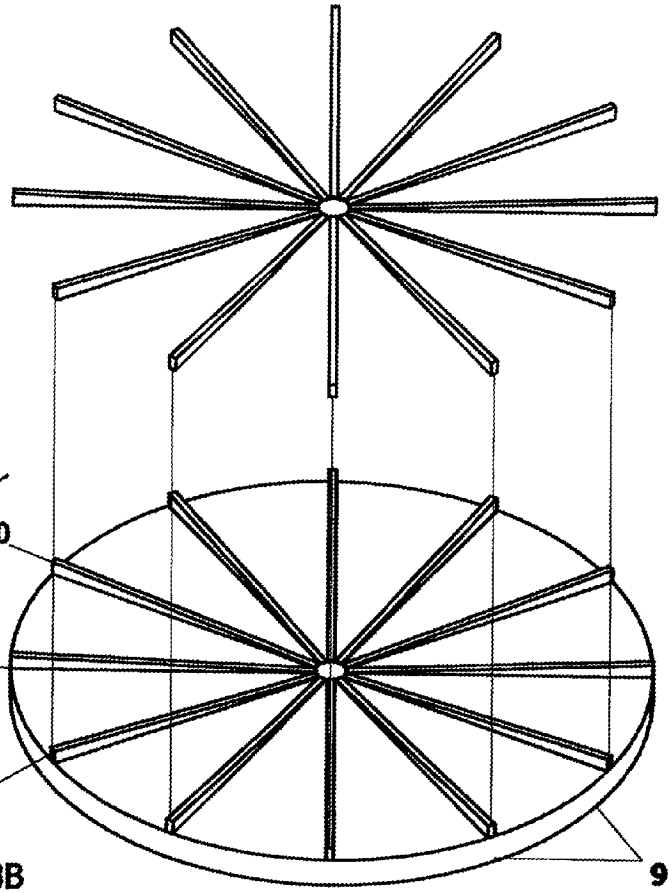
FIG. 3B is a display of the vertical die plates and stops associated with the shape of the metal object.
Figure 3A:
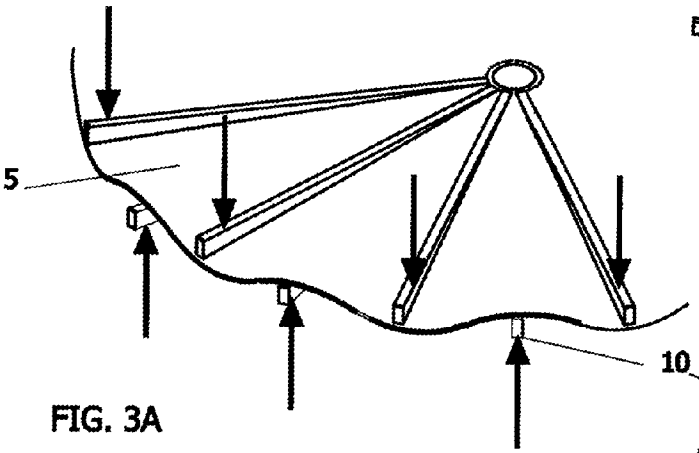
FIG. 3A displays the out of phase nature of the vertical die plate when the metal object is not flat.
Figure 4:
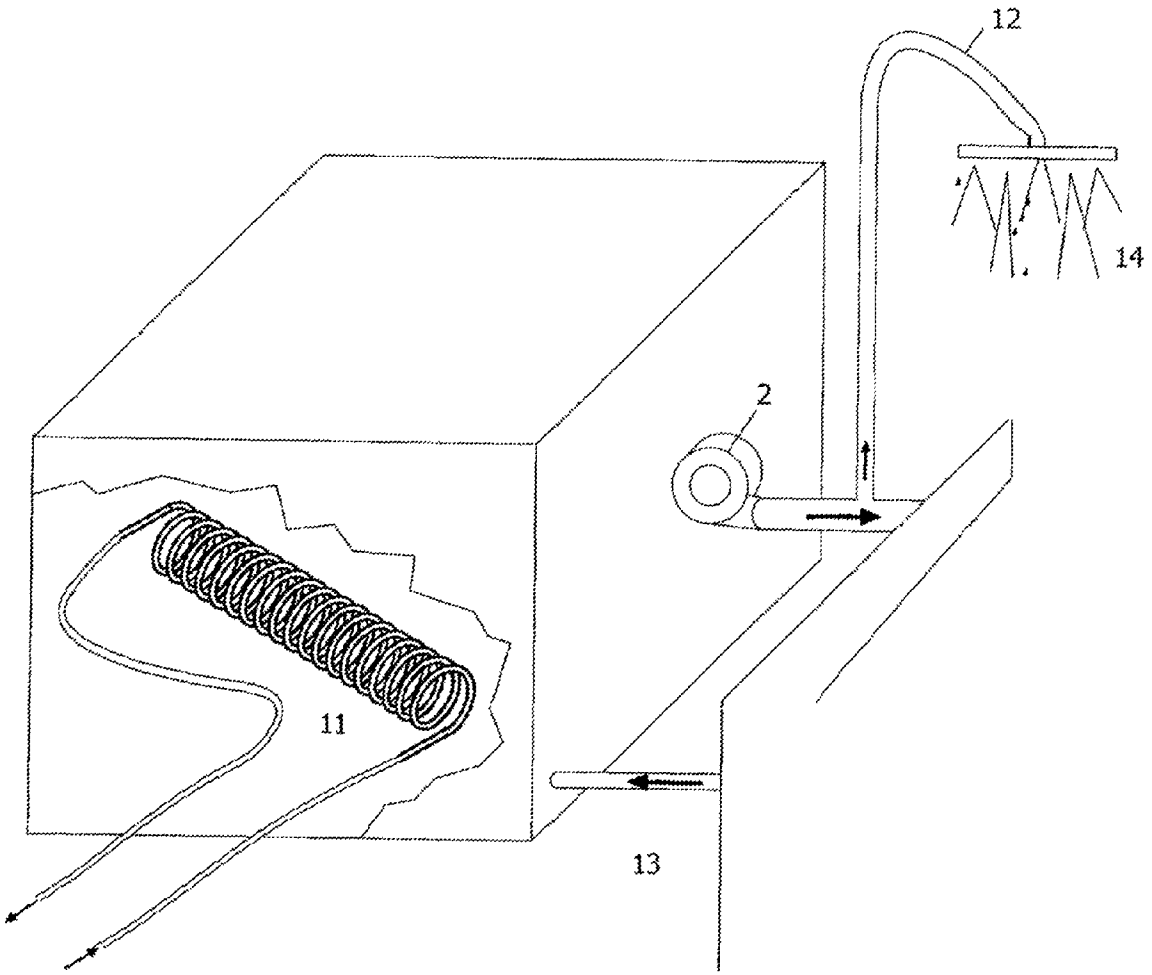
FIG. 4 is a display of the recirculation tank, including heat exchanger.

The pressure assembly 2 is that portion of the press quench machine that holds and applies pressure to a metal object 5 and comprises a plurality of stops 6, an upper base mount 7 with a plurality of upper vertical die plates 8 extending downward from the upper base mount 7, a lower base mount 9 with a plurality of lower vertical die plates 10 extending upward from the lower base mount 9. The plurality of stops 6 located around the upper base mount 7 and lower base mount 9 as indicated in FIG. 1, ensure that when the metal object 5 is inserted into the pressure assembly 2, between the upper base mount 7 and the lower base mount 9, the metal object 5 is properly oriented relative to the plurality of upper vertical die plates 8 and the plurality of lower vertical die plates 10. The plurality of upper vertical die plates 8 extend downward from the upper base mount and the plurality of lower vertical die plates 10 extend upward from the lower base mount and the plurality of upper vertical die plates 8 and the plurality of lower vertical die plates 10 are designed so that the ends opposite the respective upper base mount and lower base mount form a framework that along with the plurality of stops 6, create a framework that conforms to the original shape of the metal object 5 so that when the upper vertical dies plates 8 and lower vertical die plates 10 are pressed against the metal object 5 the combined upper vertical die plates 8, lower vertical die plates 10 and plurality of stops 6 apply pressure to the metal object 5 so that as the metal object 5 is cooled, the metal object 5 retains its original shape. The height of the upper base mount 7 relative to the lower base mount 9 is adjustable so that when a metal object 5 is inserted between the upper base mount 7 and the lower base mount 9, the upper base mount 7 can be lowered onto the metal object 5 to exert pressure on the metal object 5. There is also a plurality of nozzles 14 attached to the pressure assembly 2.

The height of the pressure assembly 2 is adjustable such that the pressure assembly 2 can be lowered into the quenchant bath 3. The quenchant bath 3 is of sufficient size so that the quenchant bath 3 can be filled with sufficient quenchant to cool the metal object 5 held by the pressure assembly 2, allow the pressure assembly 2 to be completely submerged during cooling, and does not allow the quenchant to overflow the quenchant bath 3.

The recirculation tank 4 holds additional quenchant, comprises a heat exchanger 11, is connected to the quenchant bath 3 by a plurality bath hoses 12 and the recirculation tank 4 is connected to the pressure assembly 2 by separate plurality of cooling hoses 13. There is also a means of transferring the hot quenchant from the quenchant bath 3 to the recirculation tank 4 through the bath hoses 12 and a means of transferring cooled quenchant from the recirculation tank 4 to the nozzles of the pressure assembly 2 through the cooling hoses 13. The bath hoses 12 from the quenchant bath 3 to the recirculation tank 4 transfers heated quenchant from the quenchant bath 3 to the recirculation tank 4. The heat exchanger 11 within the recirculation tank then extracts excess heat from the heated quenchant. The cooled quenchant can then be transferred from the recirculation tank 4 through the cooling hoses 13 to the pressure assembly 2. At the pressure assembly 2, the cooling hoses are connected to a plurality of nozzles 14 that spray the cooled quenchant on the metal object 5 as the metal object 5 is being submerged and while the metal object 5 is being submerged and directing the spray evenly across the metal object while submerged such that the spray ensures the metal object 5 evenly cools.

In one preferred embodiment, the metal object is a flat circular disk so that the pressure assembly is set up so that the plurality of stops, upper vertical die plates and lower vertical die plates are set to accept, apply pressure to and ensure the retention of the original shape of said flat circular disk.

In a second preferred embodiment, the metal object is an undulating circular disk so that the pressure assembly is set up so that the plurality of stops, upper vertical die plates and lower vertical die plates are set to accept, apply pressure to and ensure the retention of the original shape of said undulating circular disk.

What is claimed:

1. A press quench machine designed to apply pressure on a metal object that has been heated above its curing point such that the applied pressure assures that as the metal object cools the metal object retains its original shape comprising:

a pressure assembly, a quenchant bath and a recirculation tank;

said pressure assembly comprising a plurality of stops, an upper base mount with a plurality of upper vertical die plates associated with and extending downward from the upper base mount, a lower base mount with a plurality of lower vertical die plates associated with and extending upward from the lower base mount;

said plurality of stops, said plurality of upper vertical die plates, and said plurality of lower vertical die plates are designed to hold a heated metal object under pressure so that while the heated metal object cools the metal object retains its original shape;

the height of the upper base mount and the associated plurality of stops and upper vertical die plates being adjustable so as to be able to raise or lower the upper base mount relative to the lower base mount and the associated plurality of stops and plurality of lower vertical dies plates;

the height of the pressure assembly being adjustable such that the pressure assembly is capable of being raised or lowered into and out of the quenchant bath; and a plurality of nozzles to spray quenchant on a metal object held by the pressure assembly as the metal object is being submerged and directing the spray evenly across the metal object while submerged to evenly cool the metal object.

2. The press quench machine of claim 1 whereby the recirculation tank comprises a heat exchanger, a plurality of bath hoses, and a plurality of cooling hoses, such that hot quenchant can be transferred from the quenchant bath to the recirculation tank;

a means of transferring quenchant from the quenchant bath to the recirculation tank through the plurality of bath hoses;

the plurality of cooling hoses, that can transfer cooled quenchant form the recirculation tank to the nozzles on the pressure assembly; and a means of transferring quenchant from the recirculation tank to the nozzles of the pressure assembly through the cooling hoses.

* * * * *